US011060832B2

(12) United States Patent
Park

(10) Patent No.: US 11,060,832 B2
(45) Date of Patent: Jul. 13, 2021

(54) BLASTING METHOD AND SYSTEM

(71) Applicant: PWS SYSTEMS PTY LTD, Salter Point (AU)

(72) Inventor: Allen Park, Salter Point (AU)

(73) Assignee: PWS SYSTEMS PTY LTD, Salter Point (AU)

( * ) Notice: Subject to any disclaimer, the term of this patent is extended or adjusted under 35 U.S.C. 154(b) by 25 days.

(21) Appl. No.: 16/496,276

(22) PCT Filed: Mar. 23, 2018

(86) PCT No.: PCT/AU2018/050272
§ 371 (c)(1),
(2) Date: Sep. 20, 2019

(87) PCT Pub. No.: WO2018/170556
PCT Pub. Date: Sep. 27, 2018

(65) Prior Publication Data

US 2020/0033107 A1 Jan. 30, 2020

(30) Foreign Application Priority Data

Mar. 23, 2017 (AU) ..... 2017901046

(51) Int. Cl.
*F42D 1/28* (2006.01)
*F42D 1/18* (2006.01)
(Continued)

(52) U.S. Cl.
CPC ..... *F42D 1/28* (2013.01); *F42B 3/22* (2013.01); *F42D 1/18* (2013.01); *F42D 1/20* (2013.01); *F42D 1/22* (2013.01)

(58) Field of Classification Search
CPC ..... F42D 1/26; F42D 1/28; F42D 5/04; F42D 5/045; F42D 5/05; F42D 1/18; F42D 1/22; F42D 1/20; F42B 3/22
See application file for complete search history.

(56) References Cited

U.S. PATENT DOCUMENTS 2,403,386 A * 7/1946 Lubelsky ..... F42D 1/18 102/333
3,063,373 A * 11/1962 Boddorff ..... F42D 1/12 299/13
(Continued)

FOREIGN PATENT DOCUMENTS

CN 204438937 U * 7/2015
CN 204438937 U 7/2015
(Continued)

OTHER PUBLICATIONS

International Search Report issued in International Application No. PCT/AU2018/050272, dated Jun. 1, 2018 (5 pages).
(Continued)

*Primary Examiner* — Benjamin P Lee
(74) *Attorney, Agent, or Firm* — Osha Bergman Watanabe & Burton LLP

(57) ABSTRACT

An above ground stemming device is described which includes a body configured, in use, to cover an open end of a blast hole loaded with explosives to surface or to within 300 mm of surface. The body has a void containing a stem of superabsorbent polymer gel therein and it is positioned in use to allow the stem of superabsorbent polymer gel to be in contact with the explosives in the blast hole. The body may include a base and an upper portion extending upwardly from the base. The void may extend through the body to an opening in the base. Alternatively, the void may be encased by the body. The body may be fabricated from a rigid material or from a flexible material capable of being inflated with a fluid.

26 Claims, 5 Drawing Sheets

(51) Int. Cl.

| | |
|---|---|
| ***F42B 3/22*** | (2006.01) |
| ***F42D 1/22*** | (2006.01) |
| ***F42D 1/20*** | (2006.01) |

(56) References Cited

U.S. PATENT DOCUMENTS

| | | | | | |
|---|---|---|---|---|---|
| 3,357,193 | A * | 12/1967 | Fitzgibbon, Jr. | F42D 1/18 | 405/303 |
| 3,366,056 | A * | 1/1968 | Thunell | F42D 1/18 | 102/333 |
| 3,608,491 | A * | 9/1971 | Botes | F42D 1/18 | 102/333 |
| 4,470,352 | A | 9/1984 | Leperre | | |
| 4,543,872 | A * | 10/1985 | Graham | F42D 5/045 | 109/1 R |
| 4,660,644 | A * | 4/1987 | Egnor | E21B 33/1277 | 102/333 |
| 5,247,886 | A * | 9/1993 | Worsey | F42D 1/18 | 102/312 |
| 5,497,829 | A * | 3/1996 | Rajkovich | F42D 1/18 | 166/285 |
| 6,321,655 | B1 * | 11/2001 | Tota | F42D 3/04 | 102/302 |
| 6,708,619 | B2 * | 3/2004 | Tota | F42B 3/00 | 102/314 |
| 7,950,328 | B2 * | 5/2011 | Howerton | F42D 1/08 | 102/319 |
| 8,413,583 | B2 * | 4/2013 | Sloan | F42D 1/18 | 102/304 |
| 10,030,959 | B2 * | 7/2018 | Park | F42D 1/28 | |
| 2002/0000173 | A1 * | 1/2002 | Cho | F42D 1/00 | 102/303 |
| 2003/0015112 | A1 | 1/2003 | Gavrilovic | | |
| 2008/0236434 | A1 * | 10/2008 | Gonzalez | F42D 1/18 | 102/313 |
| 2011/0259227 | A1 * | 10/2011 | Mills | F42D 1/24 | 102/333 |
| 2012/0017791 | A1 * | 1/2012 | Sloan | F42D 1/18 | 102/304 |
| 2017/0038188 | A1 * | 2/2017 | Handel | F42D 1/28 | |

FOREIGN PATENT DOCUMENTS

| | | | | |
|---|---|---|---|---|
| CN | 108106507 | A * | 6/2018 | |
| EP | 0109067 | A1 | 5/1984 | |
| WO | WO-0036364 | A1 * | 6/2000 | F42D 1/18 |
| WO | 2012090165 | A1 | 7/2012 | |
| WO | 2014201514 | A1 | 12/2014 | |

OTHER PUBLICATIONS

Written Opinion issued in International Application No. PCT/AU2018/050272, dated Jun. 1, 2018 (4 pages).

* cited by examiner

BLASTING METHOD AND SYSTEM

TECHNICAL FIELD

The present disclosure relates to a blasting method and system, in particular to a method for above-ground stemming. The present disclosure also relates to a stemming method and an above-ground stemming arrangement for suppressing noise and dust generated during a blast event.

BACKGROUND

The following discussion of the background to the disclosure is intended to facilitate an understanding of the invention. However, it should be appreciated that the discussion is not an acknowledgement or admission that any of the material referred to was published, known or part of the common general knowledge as at the priority date of the application.

The controlled use of explosives to break rock for excavation is used across many industries including, but not limited to drilling and mining operations, quarrying and civil construction. Typically, a number of holes are drilled into the rock accordingly to a previously prepared blast hole pattern, which are then filled with explosives. The explosives are then detonated, causing the rock to fracture and break.

The energy of an explosive is imparted to the surrounding rock in a two-stage process. A shock wave (or pressure wave) is first released 3-5 ms post-detonation. The shock wave travels at ~5000 m/s and generates initial fractures in the ground surrounding the blast hole. About 25 ms post-detonation, a large quantity of expanding gas is generated. The expanding gas travels through the cracks generated by the pressure wave to further dislodge the surrounding rock.

Stemming devices or sized aggregate may be deposited into the blast hole above the explosive charge to contain the pressure wave generated upon detonation, direct the blast and, in turn, suppress noise and dust. Stemming depths are approximately 20 times the bore-hole diameter or 300 mm below the top of the rock with overburden, when the depth of the overburden is approximately 20 times the bore diameter.

Although initial estimates for the quantity and quality of explosives required is relatively straightforward, operators must calculate the height of the aggregate stem suitable for the amount and type of explosive in the hole for maximum containment of the explosive energy. The amount, and thus height, of aggregate stem material needed to contain the explosive energy is limited strictly by the depth of the borehole. It is advantageous to have the shortest possible stemming height as these zones where no explosives exist is an area that creates oversized rock. The oversized rock creates numerous downstream processing issues.

Ideally, the aggregate stem will contain the gases generated upon detonation. However, the pressure wave imparts momentum to the aggregates as it travels through the stemming material, destabilising it and greatly reducing its ability to contain the gasses. Thus energy is lost from the explosion via the path of least resistance and not applied to the surrounding ground.

Depositing aggregate into multiple blast holes is time-consuming and hazardous because large volumes of aggregate are required. Furthermore, if the detonator fails to fire, a considerable period of time is spent in removing the aggregate to retrieve the faulty detonator or contaminated explosives.

Some of the embodiments as disclosed herein seek to address at least some of the problems identified herein.

SUMMARY

The inventor has found that an above ground stemming device as disclosed herein reflects a pressure wave generated upon detonation of explosives within the blast hole, thereby increasing the efficiency of the explosive in the blast hole during blasting as well as suppressing noise and dust generated during a blast event. The incidence or extent of rifling may also be reduced.

The above ground stemming device comprises a body configured, in use, to cover an open end of a blast hole loaded with explosives to surface or to within 300 mm of surface, the body having a void containing a stem of superabsorbent polymer gel therein, wherein the body is positioned in use to allow the stem of superabsorbent polymer gel to be in contact with the explosives.

Various embodiments of the disclosure also provide an above ground stemming method for suppressing noise and dust generated during a blast event. Said method comprises covering an open end of a blast hole loaded with explosive to surface with the above ground stemming device as disclosed herein, and positioning said to allow the stem of superabsorbent polymer gel to be in contact with the explosives.

The present disclosure also provides a blasting method and system, in particular a method and system for containing a sub-surface blast event.

In one aspect of the disclosure there is provided a blasting method comprising:

loading a blast hole with explosives to surface or to within 300 mm of surface; covering an open end of the blast hole with an above ground stemming device as disclosed herein, said device being positioned to allow the stem of superabsorbent polymer gel to be in contact with the explosives; and, detonating the explosives.

Another aspect of the disclosure relates to a blast hole arrangement, said arrangement comprising a blast hole loaded with explosives to surface or to within 300 mm of surface, an above ground stemming device as disclosed herein covering an open end of said blast hole, said device being positioned to allow the stem of superabsorbent polymer gel to be in contact with the explosives.

In one embodiment of the above ground stemming device the body comprises a base and an upper portion extending upwardly from the base. Generally, the base defines a greater cross-sectional area than a cross-sectional area defined by the upper portion. In use, the base of the body covers the open end of the blast hole.

In some embodiments the respective cross-sectional areas of the base and the upper portion are constant along the longitudinal axis of the body. In one particular embodiment, the base may be a cylinder and the upper portion may be a cylindrical column. Alternatively, the base may be a polyhedron and the upper portion may be a polyhedral column.

In other embodiments, the body may be a polyhedron such as a cube, rectangular prism, square pyramid, tetrahedron, cone, cylinder, spherical cap, hemisphere, dome, conical frustrum or spherical segment.

In some of these latter embodiments, a cross-sectional area defined by the body may decrease from the base to the upper portion along the longitudinal axis of the body Illustrative examples of these particular embodiments may include, but are not limited to square pyramids, tetrahedrons, cones, domes, and hemispheres.

Generally, the void may substantially conform to respective contour(s) of the upper portion of the body. For example the void may comprise a cylindrical bore extending through the upper portion and the base of the body, wherein the upper portion comprises a cylindrical column and the base comprises a cylinder. Alternatively, the void may comprise a polyhedral bore extending through the upper portion and the base of the body, wherein the upper portion comprises a polyhedral column and the base comprises a polyhedron.

In alternative embodiments, the void may substantially conform to contour(s) of the body. For example, the void of a pyramid-shaped body may be pyramid-shaped. The void of a dome-shaped body may be dome-shaped.

The void may extend through the body to an opening in the base. Alternatively, the void may be encased by the body.

In some embodiments, the body may be fabricated from a rigid material.

In alternative embodiments, the body may be fabricated from a flexible material capable of being inflated with a fluid, such as an aqueous fluid or the superabsorbent polymer gel.

In use, the void is filled with the superabsorbent polymer gel, thereby forming the stem of superabsorbent gel. Accordingly, a shape and volume of the void defines a shape and volume of the stem of superabsorbent polymer gel within the body.

In one embodiment the superabsorbent polymer gel may comprise an aqueous fluid, a superabsorbent polymer and, optionally, a weighting agent.

The superabsorbent polymer may be a crosslinked hydrophilic polymer selected from a group comprising polyacrylic acid and polyacrylic acid derivatives, and copolymers thereof, polymethacrylic acid and polymethacrylic acid derivatives, and copolymers thereof, polyethylene glycol and polyethylene glycol derivatives and copolymers thereof, polyacrylamide polymers and copolymers, polyvinyl alcohol, polyvinyl alcohol derivatives, and copolymers thereof, or combinations thereof. Alternatively, the superabsorbent polymer may be crosslinked natural polymers selected from a group comprising polysaccharides, chitin, polypeptide, alginate or cellulose. Exemplary crosslinked natural polymers include, but are not limited to, xanthan gum, crosslinked guar gum, crosslinked starches, carboxymethyl cellulose.

In one particular embodiment, the aqueous fluid may be brackish water having a total dissolved solids between 100 to 5000 mg/L. In another particular embodiment, the aqueous fluid may be saline water having a total dissolve solids greater than 5000 mg/L.

The superabsorbent polymer gel may have a specific gravity >1.0, in particular >2.0. The superabsorbent polymer gel may comprise the weighting agent in an amount sufficient to impart the superabsorbent polymer gel with a desired specific gravity. The weighting agent may be a water soluble inorganic salt such as sodium chloride or a water insoluble inorganic material.

BRIEF DESCRIPTION OF DRAWINGS

Various embodiments of the disclosure will be described and illustrated, by way of example only, with reference to the accompanying figures in which.

DESCRIPTION OF EMBODIMENTS

Figure 1A:
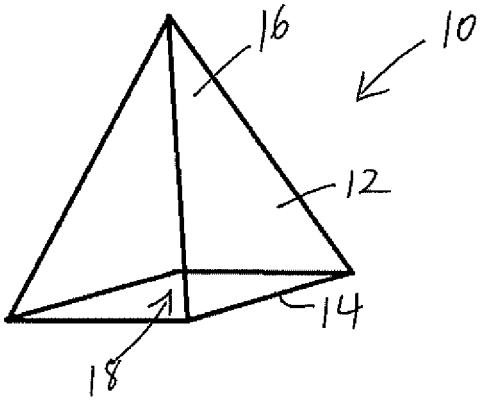
FIGS. 1*a*-1*f* illustrate various embodiments of an above-ground stemming device as described in the disclosure.
Figure 1B:
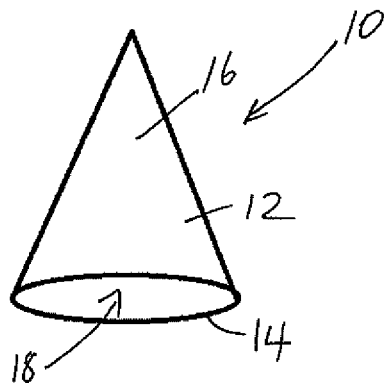
Figure 1C:
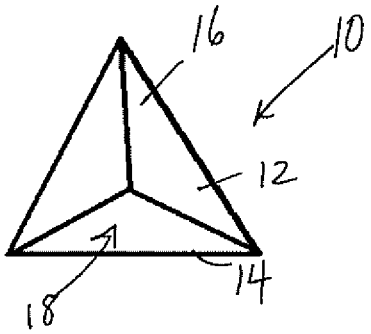
Figure 1D:
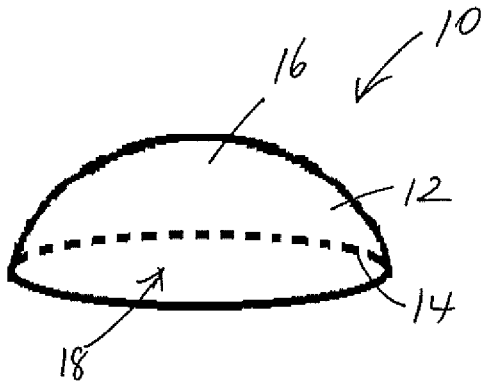

The present disclosure relates to an above ground stemming device and methods of deploying said device to contain a sub-surface blast event.

General Terms

Throughout this specification, unless specifically stated otherwise or the context requires otherwise, reference to a single step, composition of matter, group of steps or group of compositions of matter shall be taken to encompass one and a plurality (i.e. one or more) of those steps, compositions of matter, groups of steps or groups of compositions of matter. Thus, as used herein, the singular forms "a", "an" and "the" include plural aspects unless the context clearly dictates otherwise. For example, reference to "a" includes a single as well as two or more; reference to "an" includes a single as well as two or more; reference to "the" includes a single as well as two or more and so forth.

Each example of the present disclosure described herein is to be applied mutatis mutandis to each and every other example unless specifically stated otherwise. The present disclosure is not to be limited in scope by the specific examples described herein, which are intended for the purpose of exemplification only. Functionally-equivalent products, compositions and methods are clearly within the scope of the disclosure as described herein.

The term "and/or", e.g., "X and/or Y" shall be understood to mean either "X and Y" or "X or Y" and shall be taken to provide explicit support for both meanings or for either meaning.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the present specification, including definitions, will control. In addition, the materials, methods, and examples are illustrative only and not intended to be limiting.

It is to be noted that where a range of values is expressed herein, it will be clearly understood that this range encompasses the upper and lower limits of the range, and all values in between these limits.

The term 'about' as used throughout the specification means approximately or nearly and in the context of a numerical value or range set forth herein is meant to encompass variations of ±10% or less, ±5% or less, ±1% or less±, or 0.1% or less of and from the numerical value or range recited or claimed.

Specific Terms

The term 'blast hole' as used herein refers to a drilled hole of a pre-determined depth and diameter containing explosives. Generally a plurality of blast holes, such as a row or an array of blast holes, may be drilled in an open pit or underground operation according to a drill pattern for a blasting site based on parameters such as rock burden including rock type and density, spacing between blast holes, blast hole depth and diameter for a predetermined explosive, and where required, blast hole orientation and angles. The drill pattern may be designed by a drilling and blasting engineer in accordance with well-established models and protocols appropriate for the desired shaped blast.

The term 'stem' refers to a pre-determined mass and volume of a stemming material capable of at least partially dampening and/or containing the gases and forces released by detonation of explosives in a blast hole. The pre-determined mass and volume of the stemming material may be calculated by conventional techniques well understood by those skilled in the art and is dependent on the depth and diameter of the blast hole, blast hole orientation and angle of orientation from vertical, and the amount and nature of the explosives loaded into the blast hole.

The term 'superabsorbent polymer' refers to a polymeric material that is capable of absorbing at least 25 times its own weight in aqueous fluid and is capable of retaining the absorbed aqueous fluid under moderate pressure. The absorbed aqueous fluid is taken into the molecular structure of the superabsorbent polymer rather than being contained in pores from which the fluid could be eliminated by squeezing. Some superabsorbent polymers can absorb up to 1000 times their weight in aqueous fluid.

The term 'specific gravity' as used herein with reference to a solid substance is the ratio of the weight of a given volume of material to the weight of an equal volume of water (at 20° C.). The term 'specific gravity distribution' as used herein with reference to a particulate material refers to a list of values or a mathematical function that defines the relative amount, typically by mass, of particles present according to specific gravity.

Above Ground Stemming Device

One aspect of the present disclosure relates to an above ground stemming device for containing an underground blast event.

Referring to FIGS. 1*a*-1*f*, there are shown several embodiments of an above ground stemming device 10 for containing an underground blast event.

Figure 3:
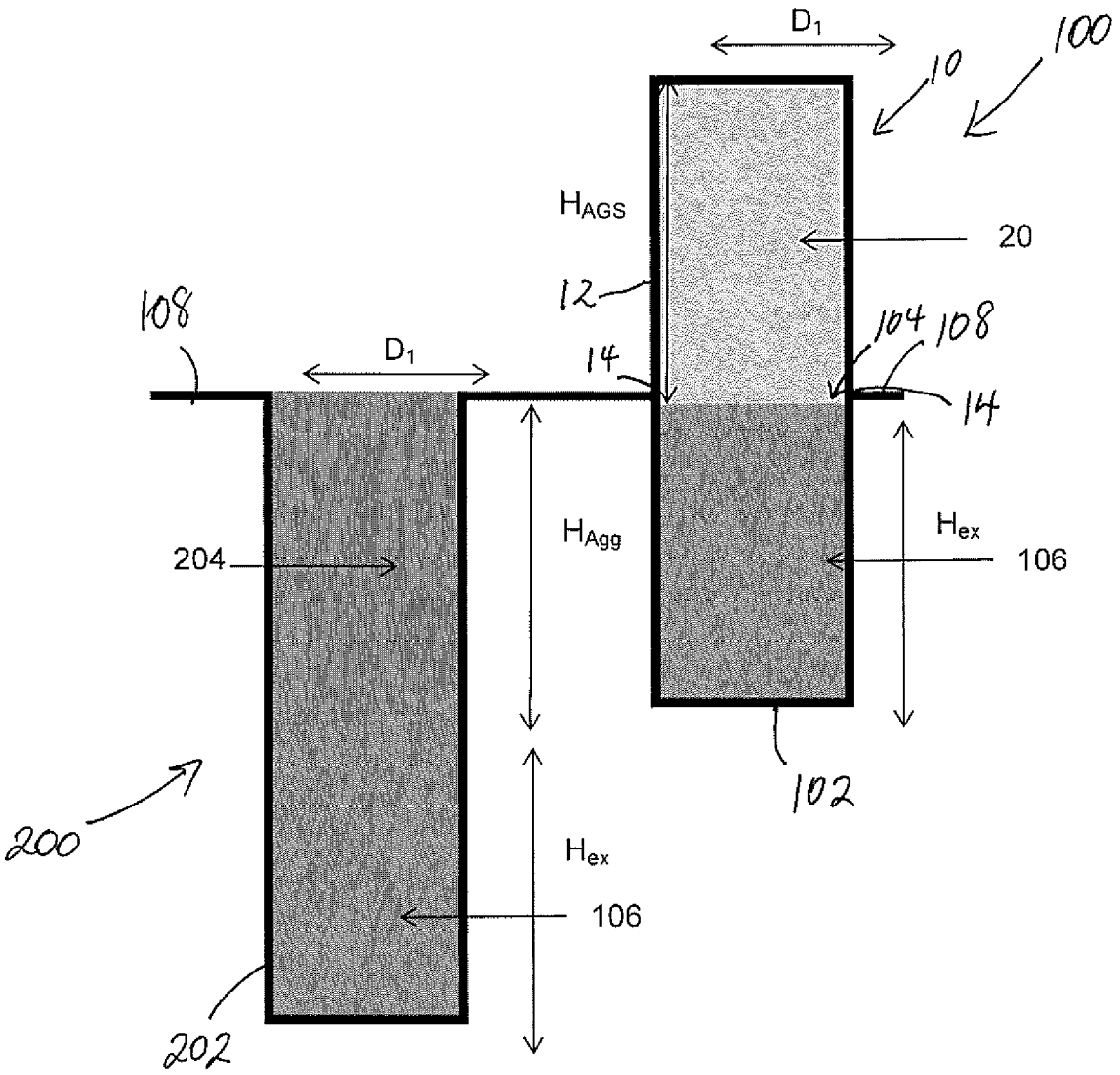
FIG. 3 is a cross-sectional view of a conventional blast hole arrangement with an aggregate stem shown in comparison to a blast hole arrangement in accordance with one embodiment described in the disclosure.
Figure 4:
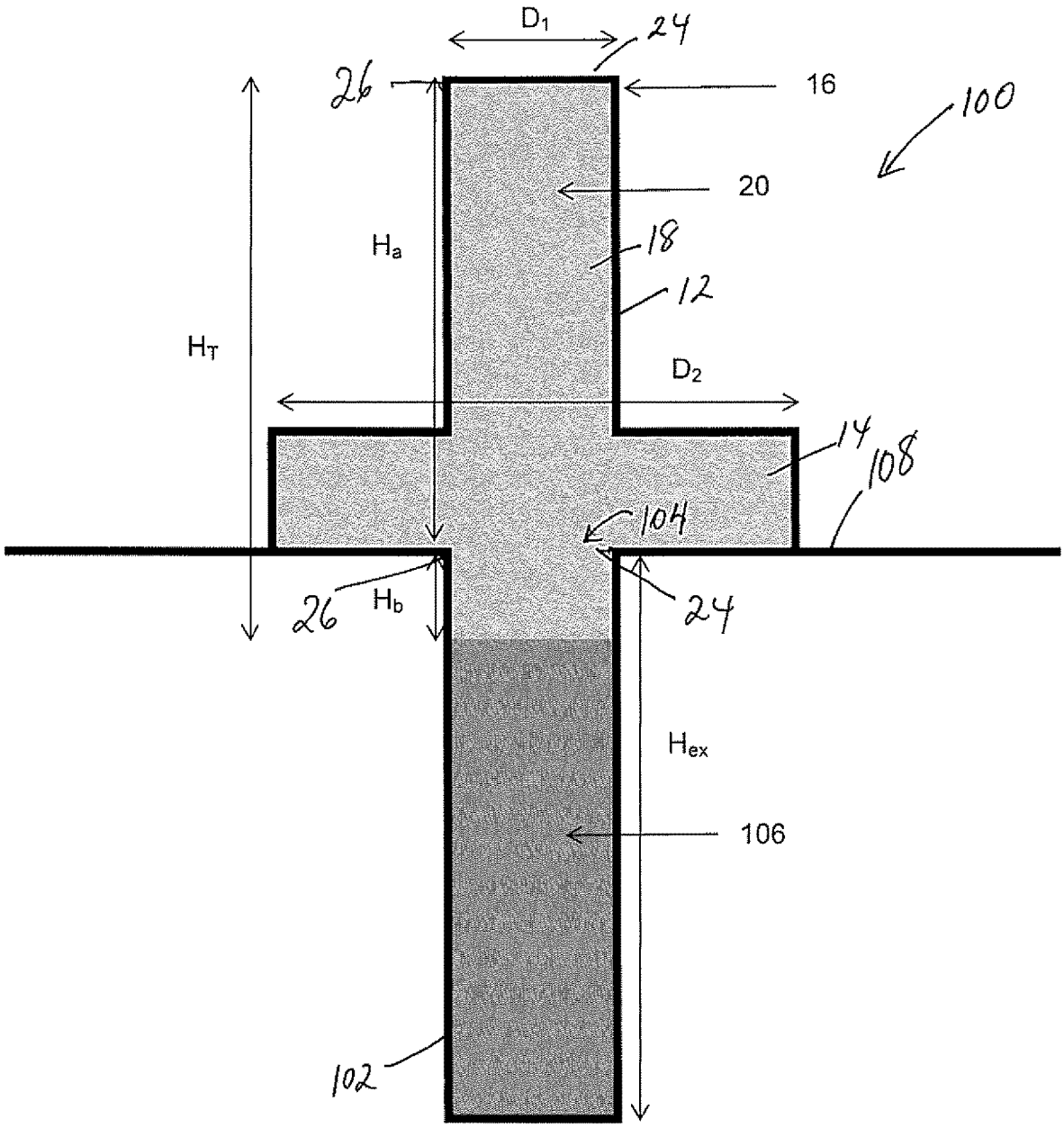
FIG. 4 is a cross-sectional view of a blast hole arrangement which employs the above-ground stemming device in accordance with various embodiments described in the disclosure and, FIG. 5 is a graphical representation of the relationship between the height of the stem of superabsorbent polymer gel in one embodiment of the above-ground stemming device disclosed herein and the resulting explosive damage.
Figure 5:
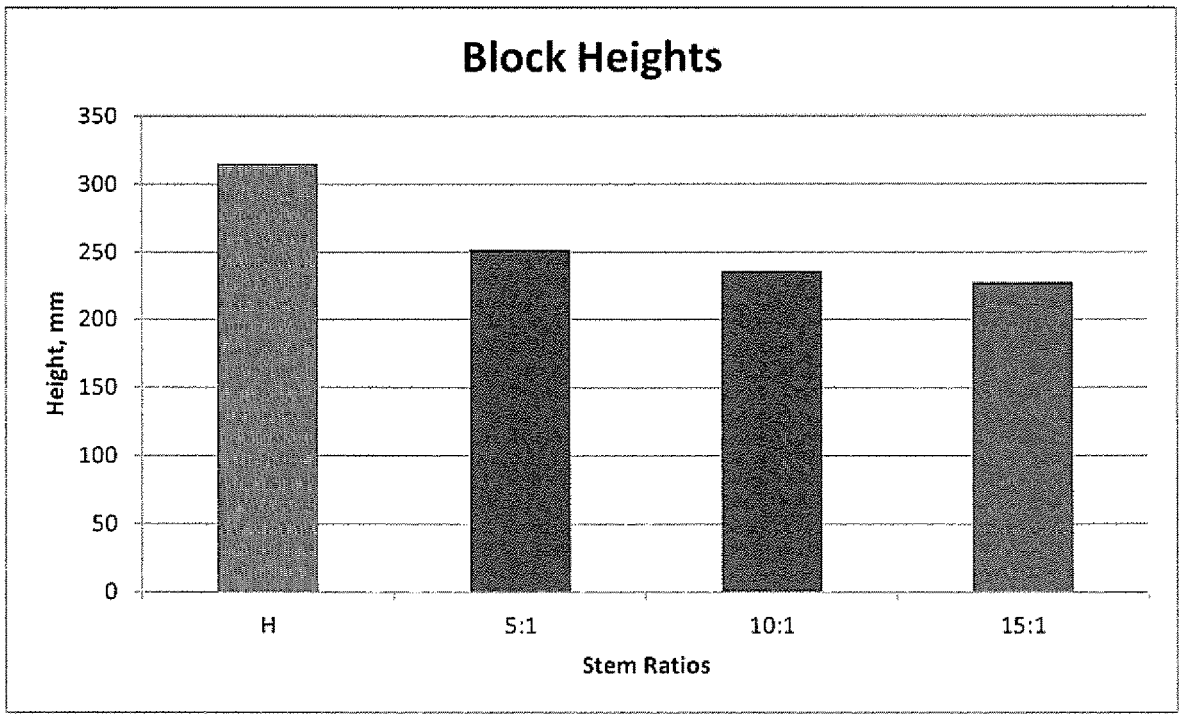

The above ground stemming device 10 comprises a body 12. The body 12 includes a base 14 and an upper portion 16 extending upwardly from the base 14. In use, the base 14 of the body 12 covers an open end 102 of a blast hole 104 loaded with explosives 106 to surface 108, as shown in FIGS. 3 and 4.

The body 12 is also provided with a void 18 containing a stem 20 of superabsorbent polymer gel therein, wherein the body 12 is positioned in use to allow the stem 20 of superabsorbent polymer gel to be in contact with the explosives 106. It will be appreciated that in embodiments wherein an uppermost portion of the explosives 106 resides marginally below the surface 108, the stem 20 of superabsorbent polymer gel may extend into the blast hole 104 to a sufficient depth to contact the explosives 106.

It will be appreciated that the base 14 will have a greater diameter than the diameter of the open end 102 of the blast hole 104 to ensure that the open end 102 is completely covered by the base 14 of the body 12. Moreover, the cross-sectional area of the base 14 is greater than a cross-sectional area of the upper portion 16 to ensure that the device 10 has a lower centre of gravity and sits stably over the open end 102 of the blast hole 104 on the surface 108.

The body 12 may take any suitable form. For example, the body 12 may be a single polyhedron such as a cube, rectangular prism, square pyramid such as in FIG. 1*a*, cone such as in FIG. 1*b*, tetrahedron such as in FIG. 1*c*, cylinder, spherical cap, hemisphere, dome such as in FIG. 1*d*, conical frustrum or spherical segment.

It will be appreciated that in some of these embodiments, a cross-sectional area defined by the body 12 may decrease from the base 14 to the upper portion 16 along a longitudinal axis 22 of the body 12. Illustrative examples of these particular embodiments may include, but are not limited to square pyramids, tetrahedrons, cones, domes, and hemispheres. The cross-sectional area may decrease continuously, as shown in FIGS. 1*a*-1*d*, or step-wise from the base 14 to the upper portion 16 along the longitudinal axis 22 of the body 12.

Figure 1E:
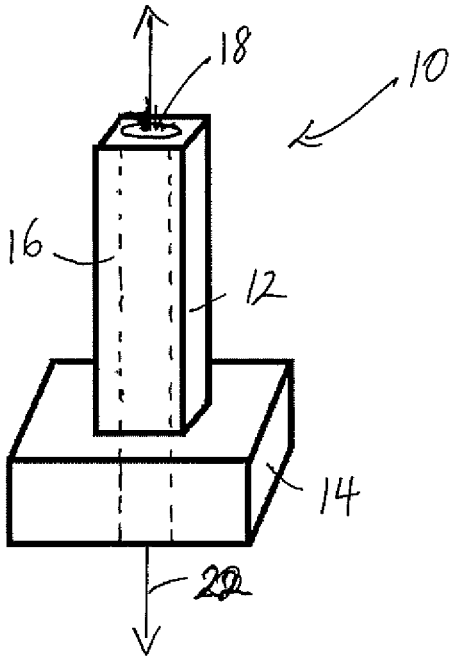
Figure 1F:
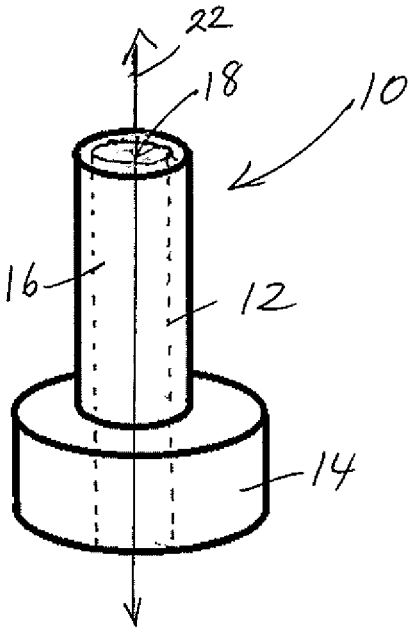
Figure 2A:
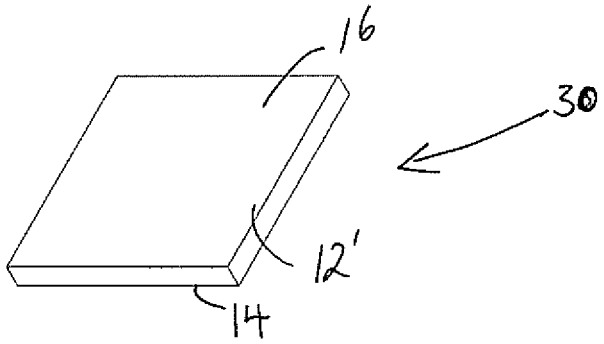
FIGS. 2*a*-2*d* illustrates various alternative embodiments of an above-ground stemming device as described in the disclosure.
Figure 2B:
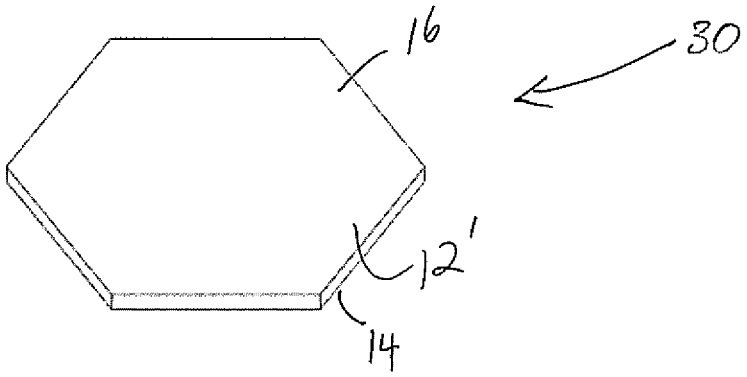
Figure 2C:
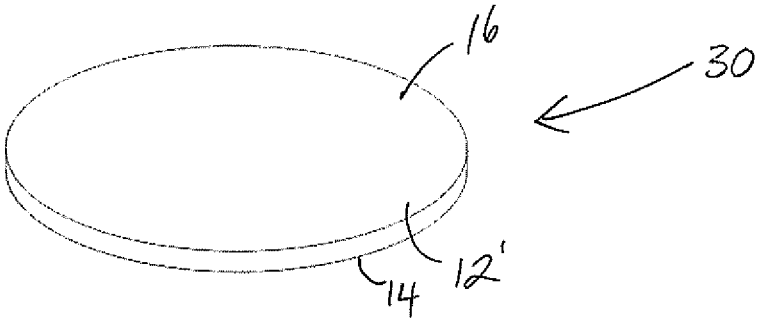
Figure 2D:
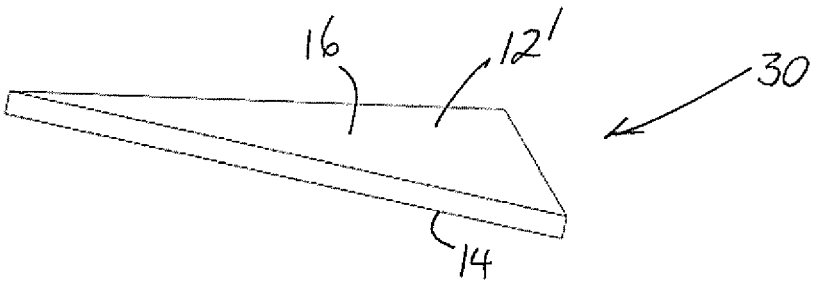

Alternatively, the base 14 may comprise a first polyhedron and the upper portion 16 may comprise a second polyhedron, as shown in FIGS. 1*e* and 1*f*. The first and second polyhedrons may be the same as shown in FIG. 1*f* or different as shown in FIG. 1*e*. For example, in FIG. 1*e*, the base 14 is a rectangular prism and the upper portion 16 is a rectangular column. In FIG. 1*f*, the base 14 is a cylinder and the upper portion 16 is a cylindrical column. In these embodiments, respective cross-sectional areas of the base 14 and the upper portion 16 are constant along the longitudinal axis 22 of the body.

The term 'void' refers to an interior space defined in the body 12. The void 18 may extend along the longitudinal axis 22 of the body 12 to an opening 24 in the base 14, thereby allowing the stem 20 of superabsorbent polymer gel to contact the explosives 106 loaded in the blast hole 104.

Alternatively, the void 18 may be encased by the body 12. In these particular embodiments, the body 12 may function as a sheath 12' for the stem 20 of superabsorbent polymer gel.

The void 18 may substantially conform to one or more contours of the body 12 or to one or more contours of the upper portion of the body 12. Accordingly, in most embodiments the shape and size of the body 12 may determine the shape and size of the void 18 therein.

For example, as shown in FIG. 1*f*, the void 18 may comprise a cylindrical bore extending along the longitudinal axis 22 of the cylindrical upper portion 16 and the cylindrical base 14.

However it will be appreciated that in some embodiments, the void 18 may not conform to the shape and size of the upper portion 16 or the body 12. For example, as shown in FIG. 1*e*, the void 18 may comprise a cylindrical bore extending along the longitudinal axis 22 of the rectangular upper portion 16 and the rectangular prismatic base 14.

In other embodiments, the body 12 may be a tube-shaped body or hollow tubular housing wherein the void 18 is defined by a bore of the tube-shaped body or hollow tubular housing.

The body 12 may be fabricated from a rigid material. Suitable examples of rigid materials include, but are not limited to, polymeric materials (plastics), in particular high density polymeric material such as high density polyethylene (HDPE), polyethylene (PE) in particular low density polyethylene (LDPE), polyvinyl chloride (PVC), polypropylene (PP) and so forth.

Alternatively, the body 12 may be fabricated from a flexible material capable of being inflated with a fluid, such as an aqueous fluid or the superabsorbent polymer gel. Fabricating the body 12 from a flexible material is particularly preferred for embodiments wherein the void 18 is encased by the body 12, and the body 12 functions as a sheath 12' for the stem 20 of superabsorbent polymer gel.

In use, the void 18 is filled with the superabsorbent polymer gel, thereby forming the stem 20 of superabsorbent gel. Accordingly, a shape and volume of the void 18 defines a shape and volume of the stem 20 of superabsorbent polymer gel within the body 12.

Various alternative embodiments of the above ground stemming device 10 are illustrated in FIGS. 2*a*-2*d*. In these particular embodiments, said body 12 is fabricated from a flexible semi-permeable membrane, wherein the body 12 is configured, in use, to be a mat 30 when the void 18 is filled with the stem 20 of superabsorbent polymer gel. The mat 30 has a thickness (i.e. depth) which is less than its lateral width. The mat 30 may take any suitable shape. For example, the mat 30 may be rectangular, hexagonal, cylindrical or triangular, as depicted in FIGS. 2*a*-2*d*.

In use, the mat 30 may be disposed to cover the open end 102 of the blast hole 104 so as to be in contact with the explosive 106 loaded to surface 108. In some embodiments, wherein the explosive 106 is loaded to within 300 mm of surface 108, additional superabsorbent polymer gel may be placed downhole in contact with the explosive 106 so as to bridge contact between the explosive 106 and the mat 30.

In other embodiments, a plurality of mats 30 may be stacked and positioned to cover the open end 102 of the blast hole 104. The plurality of mats 30 provide a cumulative stem 20' of superabsorbent polymer gel having an effective height comprising the combined depths of the stacked mats 30.

The inventor envisages that these particular embodiments of the above ground stemming device 10 may be particularly effective in mitigating the explosive blast of land mines. In this particular application, the mat 30 may be placed on top of the land mine, prior to detonation, to contain the blast.

The superabsorbent polymer gel used in said device 10 may comprise a superabsorbent polymer, an aqueous fluid and, optionally, a weighting agent.

The superabsorbent polymer may be a crosslinked hydrophilic polymer selected from a group comprising polyacrylic acid and polyacrylic acid derivatives, and copolymers thereof, polymethacrylic acid and polymethacrylic acid derivatives, and copolymers thereof, polyethylene glycol and polyethylene glycol derivatives and copolymers thereof, polyacrylamide polymers and copolymers, polyvinyl alcohol, polyvinyl alcohol derivatives, and copolymers thereof, or combinations thereof. Alternatively, the superabsorbent polymer may be crosslinked natural polymers selected from a group comprising polysaccharides, chitin, polypeptide, alginate or cellulose. Exemplary crosslinked natural polymers include, but are not limited to, xanthan gum, crosslinked guar gum, crosslinked starches, carboxymethyl cellulose.

The aqueous fluid may be water, deionised water, ultrapure, water, distilled water, municipal water, ground water, produced water or process water, waste water, brackish water or saline water.

In one particular embodiment, the aqueous fluid may be brackish water having a total dissolved solids between 100 to 5000 mg/L. In another particular embodiment, the aqueous fluid may be saline water having a total dissolve solids greater than 5000 mg/L.

The superabsorbent polymer gel may have a specific gravity >1.0, in particular >2.0. The superabsorbent polymer gel may comprise the weighting agent in an amount sufficient to impart the superabsorbent polymer gel with a desired specific gravity.

The weighting agent may be a water soluble inorganic salt such as sodium chloride or a water insoluble inorganic material.

The water insoluble inorganic material may be a Al- and/or Si-containing material including, but not limited to, clay, clay-like materials, silica, silicates, alumina, aluminates, aluminosilicates, sand, soil, drillings, diatomaceous earth, zeolites, bentonite, kaolin, hydrotalcite or combinations thereof, and so forth, a refractory material including but not limited to iron oxides, aluminium oxides, magnesium oxide, zinc oxide, cerium oxides, titanium oxides, zirconium oxides, and so forth, water-insoluble inorganic salts such as barium sulphate, calcium carbonate (e.g. in the form of dolerite), or combinations thereof.

The superabsorbent polymer gel may be prepared by combining the superabsorbent polymer, the aqueous fluid and, optionally, the weighting agent by any suitable mixer.

The weighting agent, in particular the water insoluble inorganic material, may alternatively be incorporated into the superabsorbent polymer gel by dispersing the weighting agent in the superabsorbent polymer gel. The water insoluble inorganic material may have an average particle diameter of 1 micron or greater. The water soluble inorganic material is incorporated into the superabsorbent polymer gel lattice.

It will be appreciated that the volume, mass, specific density, and other qualities of the superabsorbent polymer gel will selected and correspond to those required to stem the blast hole 104 and will be dependent on the depth and diameter of the blast hole, blast hole orientation and angle of orientation from vertical, and the amount and nature of the explosives loaded into the blast hole.

Preparing the Above Ground Stemming Device

The above-ground stemming device 10 may be prepared by filling the void 18 defined by the body 12 with superabsorbent polymer gel, the superabsorbent polymer gel having already been prepared as described above, to produce the stem 20.

In embodiments wherein the body 12 comprises a rigid body 12, the body 12 functions as a mould or housing for the stem 20 of superabsorbent polymer gel.

Alternatively, the body 12 may be fabricated from a flexible material capable of being inflated with a fluid, such as an aqueous fluid or the superabsorbent polymer gel. Fabricating the body 12 from a flexible material is particularly preferred for embodiments wherein the void 18 is encased by the body 12, and the body 12 functions as a sheath for the stem 20 of superabsorbent polymer gel.

In these particular embodiments, the above-ground stemming device 10 may be prepared by filling the void 18 of the flexible body 12 with superabsorbent polymer gel in an amount sufficient to inflate the flexible body 12 to its pre-determined shape and size.

Alternatively, the flexible body 12 may be pre-loaded with a pre-determined amount of superabsorbent polymer gel precursor, wherein said precursor is a particulate, solid or liquid. The void 18 may then be filled with an aqueous liquid which reacts with said precursor to produce the superabsorbent polymer gel. The volume of aqueous liquid used may be less than the volume of the void 18, since it is envisaged that said precursor will expand as it absorbs the aqueous liquid to produce the superabsorbent polymer gel and occupy a greater volume in the body 12 than the volume of aqueous liquid. Generally, the superabsorbent polymer gel precursor comprises a superabsorbent polymer gel and, optionally, a weighting agent.

It will be appreciated that the void 18 of the body 12 may be filled with the superabsorbent polymer gel or the aqueous liquid by any suitable conventional technique including, but not limited to, placing, pouring, pumping or injecting.

The void 18 of the body 12 may be filled with the superabsorbent polymer gel or the aqueous liquid as described above with the above ground stemming device 10 in situ, in other words, after positioning the base 14 of the body 12 over the open end 102 of the blast hole 104.

Alternatively, the void 18 of the body 12 may be filled with the superabsorbent polymer gel or the aqueous liquid (to prepare the superabsorbent polymer gel as described above), prior to positioning the base 14 of the body 12 over the open end 102 of the blast hole 104.

Above Ground Stemming Method

The disclosure also relates to an above ground stemming method which provides several advantages including, but not limited to, suppression of noise and dust generated during a blast event, a highly stable stem which cannot become a deadly projectile, no requirement for lengthy preparation or installation period—the stem as disclosed herein can be deployed very quickly without delaying blasting, the ability to retrieve faulty explosives or detonators, and the need to drill fewer blast holes.

Various embodiments of the above ground stemming and blasting methods will now be described with reference to FIGS. 2 and 3, in which the blast hole arrangement as described herein will be compared with a conventional blast hole arrangement with conventional aggregate stemming materials located downhole.

In FIG. 3 there is shown a conventional blast hole arrangement 200 with conventional stemming materials located downhole. Said blast hole arrangement 200 includes a blast hole 202 of total depth $H_1$ and diameter $D_1$. The blast hole 202 is loaded with a predetermined amount of explosives 106 to a depth $H_{ex}$ followed by a conventional aggregate stem 204, such as sized gravel, loaded to surface 108 having a stem depth $H_{Agg}$. Typically, in stem depth $H_{Agg}$ of the conventionally loaded blast hole 202, there is a propensity for oversized rock to be produced. Oversized rock requires additional processing and risk to comminute the rock to manageable size for haulage and transport and results in increased labour, processing time and energy consumption.

In FIG. 3 there is also shown a blast hole arrangement 100 according to the present disclosure. Said blast hole arrangement 100 includes a blast hole 102 of total depth $H_{1A}$ and an open end 104 having a diameter $D_1$ corresponding to the diameter $D_1$ of the blast hole 102. The blast hole 102 is loaded to surface 108 with explosives 106 (i.e. a depth of $H_{ex1}=H_{1A}=H_{ex}$).

In this particular embodiment, the above ground stemming device 10 comprises a tubular body 12 having a diameter $\geq D_1$ and height $H_{AGS}$ filled with a stem 20 of superabsorbent polymer gel also of height $H_{AGS}$. The tubular body 12 may be positioned to cover the open end 104 of the blast hole 102 so that the base 14 of the tubular body 12 sits on the surface 108 in longitudinal alignment with an edge of the blast hole 102.

The tubular body 12 may be pre-filled with a stem 20 of superabsorbent polymer gel or the tubular body 12 may be filled with superabsorbent polymer gel after positioning the tubular body 12 over the open end 104 of the blast hole 102 to produce the stem 20. In either embodiments, the stem 20 of superabsorbent polymer gel, under gravity, may reside above and in contact with the explosive 108.

Referring to FIG. 4 there is shown an alternative embodiment of a blast hole arrangement 100 and an above ground stemming device 10. Said blast hole arrangement 100 includes a blast hole 102 of total depth $H_{1A}$ and an open end 104 having a diameter $D_1$ corresponding to the diameter $D_1$ of the blast hole 102. The blast hole 102 is loaded with explosives 106 to surface 108 or no more than 300 mm from the surface 108 (i.e. a depth of $H_{ex1}=H_{1A}=H_{ex}$).

The above ground stemming device 10 in this embodiment includes a body 12 having a cylindrical base 14 and a cylindrical columnar upper portion 16 extending upwardly from the cylindrical base 14. The body 12 has an cylindrical void 18 extending along the longitudinal axis 22 of the body so that the body 12 has respective openings 24 at opposing ends 26 thereof. The cylindrical void 18 may conform to a contour of the body 12 so that diameter $D_1$ of the cylindrical void 18 in the cylindrical columnar upper portion 16 is less than diameter $D_2$ of the cylindrical void 18 in the cylindrical base 14.

The cylindrical base 14 may be positioned to cover the open end 104 of the blast hole 102 so that the cylindrical base 14 of the tubular body 12 sits on the surface 106 whereby the cylindrical void 18 of the cylindrical columnar upper portion 16 is in longitudinal alignment with the blast hole 102.

The body 12 may be filled through its uppermost opening 24 with superabsorbent polymer gel after positioning the cylindrical base over the open end 104 of the blast hole 102. In this particular embodiment, an excess of superabsorbent polymer gel may be provided so that a portion of the superabsorbent polymer gel is introduced into the blast hole 104 and contacts the explosive 108.

Example

The invention is further illustrated by the following example. The example is provided for illustrative purposes only. It is not to be construed as limiting the scope or content of the invention in any way.

Three columns of 100 MPa concrete measuring 315 mm in height, and 140 mm in diameter were used to simulate ground conditions of a hard rock blast. In the centre of each column, an 8 mm hole was drilled to accommodate the explosive charge. #8 detonator caps were used to provide the explosive energy. A superabsorbent polymer gel stem of 2.0 SG was applied above the blast holes. The stem was contained within a length of standard 20 mm PVC pipe. A minor amount of PWS gel stem was placed around the base of the above ground stem columns to keep them upright.

The blocks were configured as follows:

1. Depth 67 mm, 1×#8 detonator (67 mm), 120 mm of 2.0 SG PWS gel stem (12.6 cc, 25.2 g) above ground
2. Depth 67 mm, 1×#8 detonator (67 mm), 80 mm of 2.0 SG PWS gel stem (25.1 cc, 50.3 g) above ground 3. Depth 67 mm, 1×#8 detonator (67 mm), 40 mm of 2.0 SG PWS gel stem (37.7 cc, 75.4 g) above ground The blocks were detonated simultaneously and results recorded on a high speed camera, configured to 720p and 120 frames per second.

To provide a baseline balance point, another identical concrete block had been drilled out to 170 mm, loaded with a #8 detonator and allowed to fire without stem.

The extent of destruction of the concrete block (as measured by the change in height of the concrete block after detonation) correlated with the stem height and stem ratio is shown in the Table.

TABLE

| Stem Ratio | Above Ground Stem Height, mm | Block Final Height, mm | % Change |
|---|---|---|---|
| 5:1 | 40 | 252 | 20 |
| 10:1 | 80 | 236 | 25 |
| 15:1 | 120 | 227 | 27 |

Results & Discussion

The baseline block suffered no apparent damage and rifled into the air. The three blocks using PWS gel stem each suffered considerable damage in direct correlation to the height of stem applied.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An above ground stemming device comprising a body configured, in use, to cover an open end of a blast hole loaded with explosives to surface or within 300 mm from surface, the body having a void containing a stem of superabsorbent polymer gel therein, wherein the body is positioned in use to allow the stem of superabsorbent polymer gel to be longitudinally co-extensive and in contact with the explosives.

2. The above ground stemming device according to claim 1, wherein the body comprises a base and an upper portion extending upwardly from the base.

3. The above ground stemming device according to claim 2, wherein the base defines a greater cross-sectional area than a cross-sectional area defined by the upper portion.

4. The above ground stemming device according claim 1, wherein the respective cross-sectional areas of the base and the upper portion are constant along a longitudinal axis of the body.

5. The above ground stemming device according to claim 4, wherein the base is a cylinder and the upper portion is a cylindrical column.

6. The above ground stemming device according to claim 1, wherein the body is a regular polyhedron selected from a group comprising a cube, rectangular prism, square pyramid, tetrahedron, cone, cylinder, spherical cap, hemisphere, dome, conical frustrum or spherical segment.

7. The above ground stemming device according to claim 6, wherein the cross-sectional area defined by the body decreases from the base to the upper portion along a longitudinal axis of the body.

8. The above ground stemming device according to claim 2, wherein the void conforms to respective contour(s) of the upper portion of the body.

9. The above ground stemming device according to claim 1, wherein the void conforms to respective contour(s) of the body.

10. The above ground stemming device according to claim 1, wherein the void extends through the body to an opening in the base.

11. The above ground stemming device according to claim 1, wherein the void is encased by the body.

12. The above ground stemming device according to claim 1, wherein the body is fabricated from a rigid material.

13. The above ground stemming device according to claim 1, wherein the body is fabricated from a flexible material capable of being inflated with a fluid.

14. The above ground stemming device according to claim 13, wherein the body is a mat.

15. The above ground stemming device according to claim 1, wherein a shape and size of the void defines a shape and size of the stem of superabsorbent polymer gel within the body.

16. The above ground stemming device according to claim 1, wherein the superabsorbent polymer gel comprises an aqueous fluid, a superabsorbent polymer and, optionally, a weighting agent.

17. The above ground stemming device according to claim 16, wherein the superabsorbent polymer comprises a crosslinked hydrophilic polymer selected from a group comprising polyacrylic acid and polyacrylic acid derivatives, and copolymers thereof, polymethacrylic acid and polymethacrylic acid derivatives, and copolymers thereof, polyethylene glycol and polyethylene glycol derivatives and copolymers thereof, polyacrylamide polymers and copolymers, polyvinyl alcohol, polyvinyl alcohol derivatives, and copolymers thereof, or combinations thereof, or a crosslinked natural polymer selected from a group comprising polysaccharides, chitin, polypeptide, alginate or cellulose.

18. The above ground stemming device according to claim 16, wherein the aqueous fluid comprises brackish water having a total dissolved solids between 100 to 5000 mg/L or saline water having a total dissolve solids greater than 5000 mg/L.

19. The above ground stemming device according to claim 16, wherein the superabsorbent polymer gel has a specific gravity >1.0.

20. The above ground stemming device according to claim 19, wherein the superabsorbent polymer gel comprises the weighting agent in an amount sufficient to impart the superabsorbent polymer gel with specific gravity >1.0.

21. The above ground stemming device according to claim 20, wherein the weighting agent comprises a water soluble inorganic salt or a water insoluble inorganic material.

22. The above ground stemming device according to claim 21, wherein the water insoluble inorganic material is selected from a group comprising a Al- and/or Si-containing material including, but not limited to, clay, clay-like materials, silica, silicates, alumina, aluminates, aluminosilicates, sand, soil, drillings, diatomaceous earth, zeolites, bentonite, kaolin, hydrotalcite or combinations thereof, and so forth, a refractory material including but not limited to iron oxides, aluminium oxides, magnesium oxide, zinc oxide, cerium oxides, titanium oxides, zirconium oxides, and so forth, water-insoluble inorganic salts such as barium sulphate, calcium carbonate (e.g. in the form of dolerite), or combinations thereof.

23. An above ground stemming method for suppressing noise, dust and/or fly rock generated during a blast event, said method comprising covering an open end of a blast hole loaded with explosive to surface with an above ground stemming device as defined in claim 1, and positioning said device to allow the stem of superabsorbent polymer gel to be longitudinally co-extensive and in contact with the explosives.

24. A blasting method comprising:

loading a blast hole with explosives to surface;

covering an open end of the blast hole with an above ground stemming device as defined in claim 1, said device being positioned to allow the stem of superabsorbent polymer gel to be longitudinally co-extensive and in contact with the explosives; and, detonating the explosives.

25. A blast hole arrangement, said arrangement comprising a blast hole loaded with explosives to surface, and an above ground stemming device as defined in claim 1, wherein said device is positioned to cover an open end of the blast hole and allow the stem of superabsorbent polymer gel to be longitudinally co-extensive and in contact with the explosives.

26. The above ground stemming device according to claim 16, wherein the superabsorbent polymer gel has a specific gravity >2.0.

* * * * *